United States Patent [19]

Allsop

[11] 4,306,661

[45] Dec. 22, 1981

[54] SHOE MOUNTING AND DISPLAY APPARATUS

[76] Inventor: Ivor J. Allsop, 2079 N. Shore Rd., Bellingham, Wash. 98225

[21] Appl. No.: 129,845

[22] Filed: Mar. 13, 1980

[51] Int. Cl.[3] ..... A47F 7/08

[52] U.S. Cl. ..... 211/37; 248/223.3; 248/243; 248/297.2

[58] Field of Search ..... 211/34–37; 248/221.4, 223.3, 243, 297.2

[56] References Cited

U.S. PATENT DOCUMENTS

| | | | |
|---|---|---|---|
| 2,674,431 | 4/1954 | Attwood | 248/243 |
| 2,958,695 | 5/1976 | Allsop et al. | 211/37 |
| 3,425,564 | 2/1969 | Allsop | 211/37 |
| 4,192,424 | 3/1980 | Allsop | 211/37 |

*Primary Examiner*—Ernest R. Purser

*Attorney, Agent, or Firm*—Hughes, Barnard & Cassidy

[57] ABSTRACT

A vertical column member having sets of vertically spaced mounting brackets mounted thereto. Each mounting bracket has at its inner end two resilient arm portions, each having a laterally extending mounting lip, with the two lips fitting in a related pair of channel members that define a slideway. Between each pair of adjacent vertically spaced brackets, there is positioned a spacing and locking element which holds the two arm portions in positive engagement with the channels of the slideway. By moving the locking and spacing element out of engagement, the inner arm portions can be sprung inwardly and the bracket removed from the slideway.

13 Claims, 9 Drawing Figures

SHOE MOUNTING AND DISPLAY APPARATUS

BACKGROUND OF THE INVENTION

The present invention relates to a mounting and display apparatus, particularly adapted to mount pairs of shoes that are in turn mounted to a shoe tree.

For many years shoes or boots have commonly been displayed in retail stores simply by placing the shoes on a horizontal shelf which is sometimes slanted to provide a better view of the shoes. To display the shoes in a more attractive manner, there have been in more recent years devices which mount the shoes to support brackets, which in turn are mounted to a center post. One such device is shown in U.S. Pat. No. 3,425,564, Allsop, where there is shown a center post with a plurality of sets of vertically spaced mounting brackets. Each pair of shoes which is to be displayed is mounted to an individual support frame in a manner that the soles of each pair are facing one another. Then the frame is positioned between a vertically adjacent pair of brackets so that each pair of shoes extends outwardly from the center post, with the top of each shoe facing laterally.

A quite similar apparatus is shown in U.S. Pat. No. 3,958,695, Allsop et al. Also a similar apparatus is shown in U.S. Pat. No. 4,192,424, Allsop, where there is a center column with a plurality of vertically extending slideways. There are a plurality of vertically spaced support platforms, each having an inner mounting end with two laterally extending lips which fit into channels of the slideway. A cam member can be rotated to move the lips outwardly into firm frictional engagement with the channels of the slideway.

It is an object of the present invention to provide a shoe mounting and display apparatus where individual mounting brackets can quite easily be mounted to a related slideway, and also easily removed therefrom, and yet have the mounting brackets held in proper spaced relationship and firmly held in the slideway.

Other advantages of the present invention will become apparent from the following detailed description.

SUMMARY OF THE INVENTION

The shoe display and mounting apparatus of the present invention comprises a base member defining a slideway having two inwardly facing channel members defining related channels. A plurality of brackets are adapted to be mounted to the slideway, with each bracket having an inner mounting end and an outer end. Each bracket comprises two laterally spaced arm members at the inner end of the bracket, and two laterally extending mounting elements located one on each arm member and adapted to fit in a related one of said channels. The arm members are capable of being yieldingly pressed laterally towards one another so that the mounting elements can be inserted in the channels.

There are a plurality of spacing elements, each of which is adapted to be mounted in the slideway between adjacent brackets to maintain the brackets in proper spaced relationship. The spacing elements and the arm members have interfitting locking portions having an engaged position and a disengaged position. In the engaged position, the locking portions hold the arm members in said channels.

Desirably, the spacing elements have lateral edge portions adapted to fit into the channels, with these edge portions being spaced from one another by a distance only moderately greater than a distance between the channel members. Thus, each of the spacing elements can be inserted into the channels by first inserting one edge portion fully into the channel and then moving a second of the edge portions into alignment with a second of the channels. When the locking portions are in their engaged position, the spacing elements is centered in the channel so as to be securely engaged therein.

In the preferred form, the locking portions comprise interfitting tongue and groove means located on the spacing elements and the brackets. Preferably, each spacing element has its locking portions on upper and lower parts thereof so that each bracket is locked in its mounted position at upper and lower locations.

Other features of the present invention will become apparent from the following description.

DESCRIPTION OF THE PREFERRED EMBODIMENT

Figure 1:
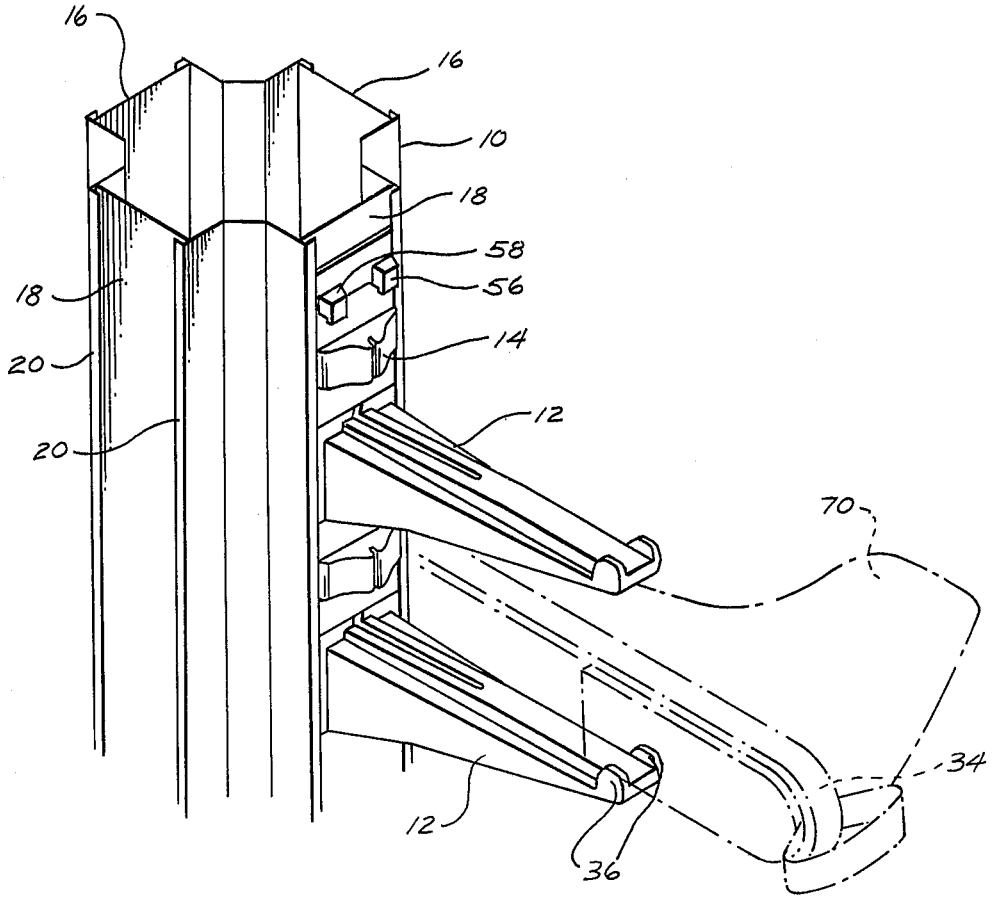
FIG. 1 is an isometric view of an upper portion of the apparatus of the present invention.

In the present invention, the main components are: a vertically positioned column member 10, a plurality of elongate mounting brackets 12, and a plurality of spacing and locking elements 14. The mounting brackets 12 are arranged in four sets, with the brackets 12 of each set being vertically spaced along the length of the column member 10. For convenience of illustration, only two brackets 12 of one set are shown. The manner in which the mounting brackets 12 cooperate to mount shoe trees to the apparatus will be described later herein, with reference to FIGS. 6 and 7. The spacing and locking elements 14 fit between adjacent pairs of vertically spaced brackets 12, and serve three functions. As the name implies, the element 14 first served to keep the brackets 10 in proper spaced relationship. Second, these elements 14 interfit with adjacent pairs of brackets 12 to maintain the brackets 12 in proper mounting engagement with the column member 10. Third, each element 14 centers a shoe tree mounted to the apparatus.

The column member 10 is generally of tubular construction and is mounted to a suitable base (not shown). It comprises four elongate plate portions 16, each having an outwardly facing mounting surface 18, with the four surfaces 18 being arranged symmetrically about the column member 10 so that these surfaces make an angle of 90° with the adjacent surfaces. At the outer vertical edge of each surface 18, there is a related channel member 20 defining a channel 22. Each pair of channel members 20, along with its related mounting surface 18, make a vertical slideway to mount one set of mounting brackets 12.

Each mounting bracket 12 has an outer end 24 and an inner end 26 by which it is mounted to the column member 10. Each bracket 12 has an elongate configuration and comprises an upper plate portion 28, side web portions 30, and an inner mounting portion 32. The plate portion 28 is contoured in a manner to properly engage a shoe tree 34 which is mounted thereto. At the outer end of each bracket 12 are a pair of upstanding protrusions 36 between which the shoe tree 34 fits.

The inner portion of the upper plate 28 is formed with an elongate thru slot 38 to form the inner portion of the bracket 12 into two arm members 40. The bracket 12 is made of a moderately yielding plastic material so that with the formation of the slot 38, the two arm portions 40 are able to be sprung inwardly toward one another, with the resiliency of the arm portions 40 bringing these arm portions 40 back out to their normal spaced location.

The mounting portion 32 comprises two laterally extending mounting flanges 42, each mounted to an outside inner edge of a related arm portion 40, and adapted to fit in a related channel 22. Each arm portion 40 at its inner mounting end has a reinforcing plate member 44 which is spaced moderately forwardly from its related mounting flange 42. At the lateral inner edge of each plate member 44, there is a related reinforcing flange 46.

Figure 5:
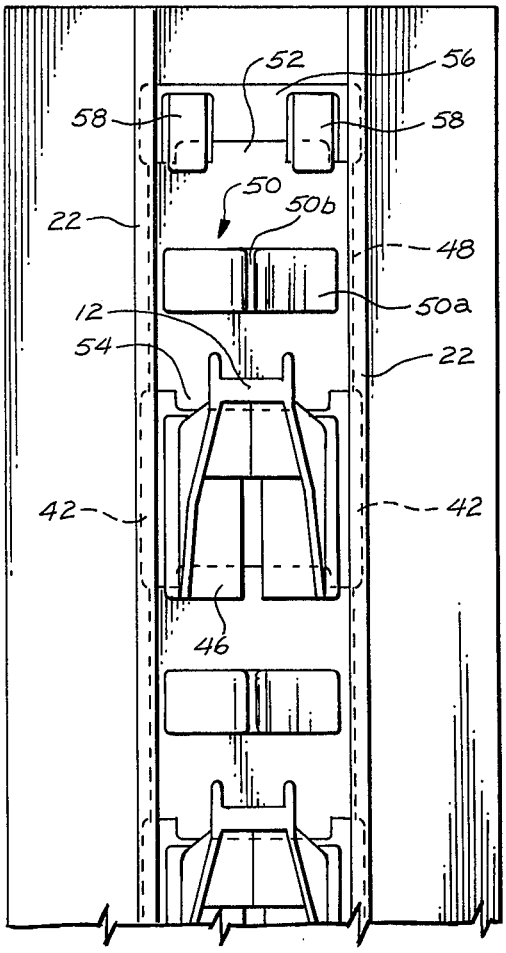
FIG. 5 is a side elevational view looking toward the outer end of the brackets of the apparatus of FIG. 1.
Figure 9:
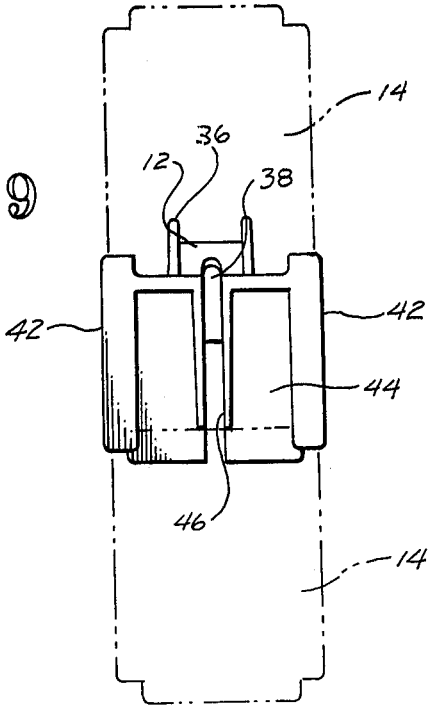
FIG. 9 is a view looking toward a base portion of the bracket of FIG. 8, and showing two spacing elements in broken lines in their engaged interlocking position with the bracket.

Reference is now made to FIGS. 5 and 9 to describe the spacing and locking elements 14. Each element 14 has a generally rectangular plate like configuration, and the side edges 48 of each element 14 are adapted to fit into related channels 22. On the outer face of each element 14 there is a locating member 50 which has sloped faces **50*a* and a center slot 50*b*, so as to be particularly contoured to interfit with a mating element on the base portion (not shown for ease of illustration) of the shoe tree 34. Thus, when the shoe tree 34 is mounted between a pair of vertically adjacent brackets 12, the base of the shoe tree 34 is properly centered against the column member 10**.

At the upper and lower edges of each spacing and locking element 14, there is a related upper and lower locking tab 52 and 54, respectively. The upper locking tab 52 fits between the lower inner edge portions of the two mounting flanges 42 of the bracket 12 immediately above. The lower locking tab 54 fits between the two upper inner edge portions of the mounting flanges 42. Thus, from an examination of FIGS. 5 and 9, it becomes apparent that with a pair of spacing and locking elements 14 positioned one above and one below a mounting portion 32 of a bracket 12, the locking tabs 52 and 54 hold the two arm portions 40 of the bracket 12 outwardly so that the mounting flanges 42 are securely engaged in their related channels 22.

Figure 2:
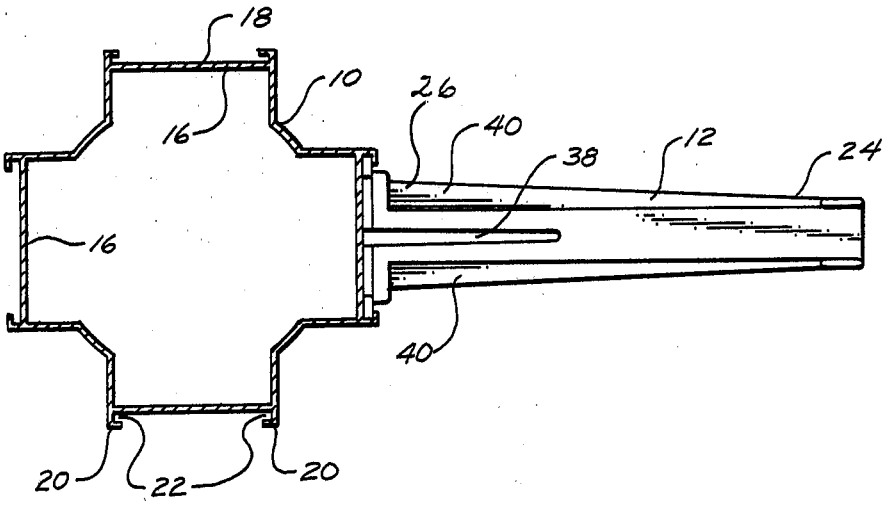
FIGS. 2, 3 and 4 are sectional views taken through the column of the apparatus of the present invention, showing the manner in which a mounting bracket can be removed (or inserted) from the column member.
Figure 3:
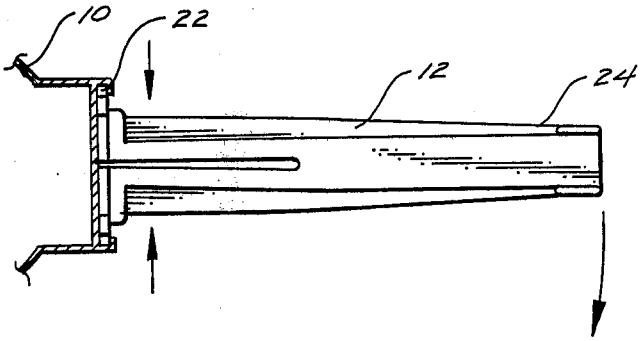
Figure 4:
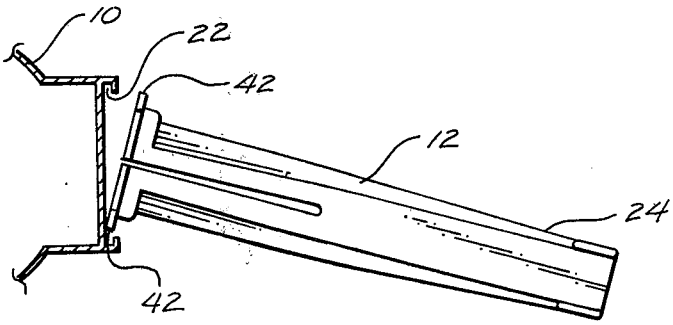

To describe the manner of assembling the component parts of the present invention, reference is first made to FIGS. 2 thru 4. In FIG. 2, one of the brackets 12 is shown mounted to the column member 10. As indicated previously, the two arm portions 40 are moderately resilient, and their normal position is that these arm portions 40 be spaced moderately from one another. In that position, the two lateral mounting flanges 42 are engaged in the pairs of opposed channels 22, as in FIG. 2.

To remove the mounting bracket 12 from the column 10, the two arm portions 40 are pressed toward one another (see FIG. 3), and the outer end 24 of the bracket 12 is swung laterally from the position of FIG. 3 to the position of FIG. 4. Then the bracket 12 can be quite easily moved away. Thus, if one bracket 12 becomes broken, it is a quite simple matter to remove the bracket 12 without having to slide it upwardly through the channel members 20, which would necessitate the removal of the brackets 12 and elements 14 located above.

However, as it will be noted from an examination of FIGS. 5 and 9, when the brackets 12 are in locking engagement with the elements 14, the brackets 12 are held securely in place. Thus, to perform the removal operation illustrated in FIGS. 2 thru 4, it is first necessary to raise the spacing element 14 upwardly, move the bracket 12 a slight distance upwardly, so that it is free of the elements 14 immediately above and below, and then perform the operation illustrated in FIGS. 2 thru 4.

To mount each bracket 12 to the column 10, the bracket 12 is first placed in a position of FIG. 4, the arm portions 40 are pressed toward one another, the bracket 12 is moved to the position of FIG. 3, and then released so that the bracket 12 assumes the position of FIG. 2. The bracket 12 is then placed in locking engagement with the elements 14 immediately above and below.

Each spacing and locking element 14 is so dimensioned that its side edges 48 are only moderately larger than the distance between the inner edges of the two channel members 20, so that it has a relatively loose fit in the channels 22. Thus, it is possible to directly slip an element 14 into position between the channels 22 by moving one edge 48 all the way into the channel 22 and then moving the other edge 48 by the opposite channel member 20 and into alignment with the channel 22. However, when the element 14 comes into locking engagement with an adjacent bracket 12, it automatically becomes centered with respect to the channel members 20 so that it is securely held in placed. If it is moved out of locking engagement with the brackets 12 (this being accomplished by moving adjacent brackets 12 slightly apart), then the element 14 can easily be removed.

When one set of brackets 12 and spacing and locking elements 14 are mounted in vertically spaced relationship in column 10, there is a top locking member 56 which is inserted into the top portion of the two channel members 20. This locking member 56 has two downwardly extending fingers 58 which engage the top edge of the base portion of a shoe tree 34 which is mounted to the top portion of the column 10.

Figures 6, 7:
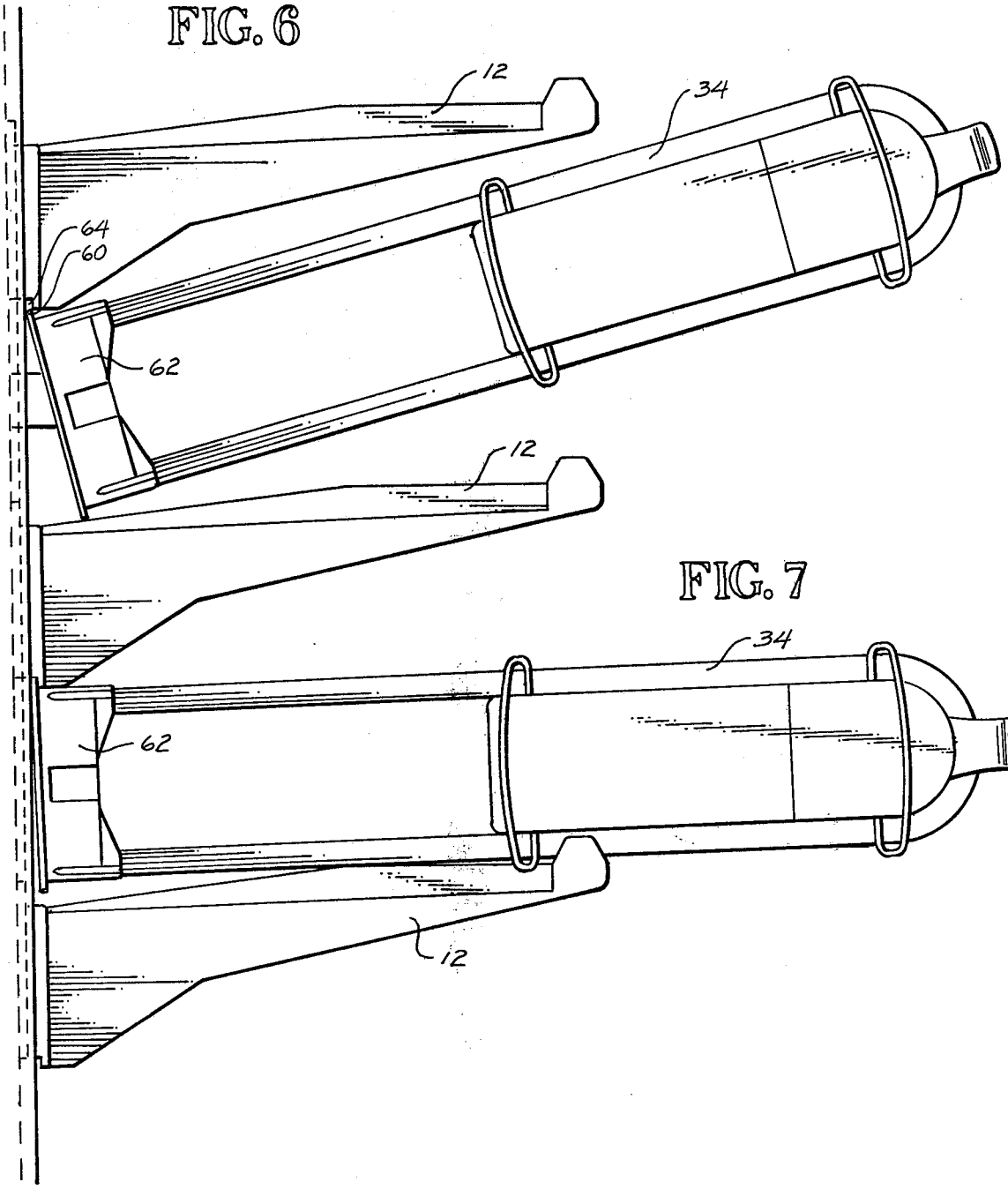
FIGS. 6 and 7 are side elevational views showing the manner in which a shoe tree can be mounted to the apparatus of the present invention.
Figure 8:
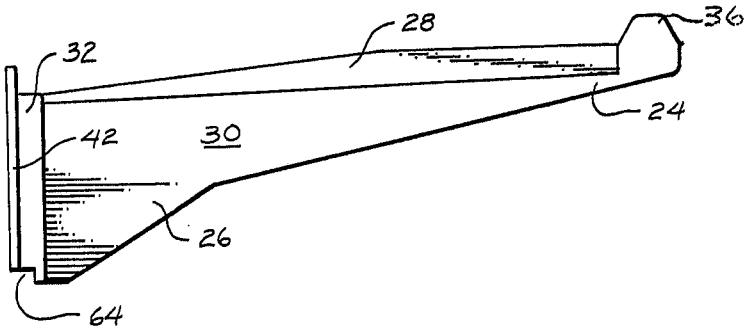
FIG. 8 is a side elevational view of one of the brackets of the present invention.

With the brackets and spacing and locking elements 14 mounted to the column 10, as shown in FIG. 1, the method of mounting a shoe tree 34 to the apparatus is easily accomplished as shown in FIGS. 6 and 7. First, the shoe tree 34 is tilted moderately so that an upper edge portion 60 of the base 62 of the tree engages a slot 64 formed by the two lower rear edges of the web portions 30 of the bracket 12. Then the shoe tree 34 is rotated downwardly so that the base 62 rests against one of the elements 14, with the locating member 50 centering the shoe tree 34 as described above. The shoe tree 34 is then supported by the outer end 26 of the bracket 12, and is centered between the two protrusions 36. The base of the shoe tree 34 has its lower base surface contoured to mate with the element 50, so that the tree 34 is properly centered. The shoe tree 34 is or may be of conventional design, and the manner in which it holds a boot or shoe 70 is shown in broken lines in FIG. 1.

What is claimed is:

1. A shoe display and mounting apparatus, comprising:

a. a base member defining a slideway having two inwardly facing channel members defining related channels, b. a plurality of brackets adapted to be mounted to said slideway, each bracket having an inner mounting end and an outer end and comprising:

1. two laterally spaced arm members at the inner end of the bracket, 2. two laterally extending mounting elements located one on each arm member and adapted to fit in a related one of said channels, 3. said arm members being capable of being yieldingly pressed laterally towards one another so that said mounting elements can be inserted into said channels, c. a plurality of spacing elements, each adapted to be mounted in said slideway between adjacent brackets to maintain said brackets in proper spaced relationship, d. said spacing elements and said arm members having interfitting locking portions having an engaged position and a disengaged position, with the locking portions in the engaged position holding said arm members in said channels.

2. The apparatus as recited in claim 1, wherein said spacing elements have lateral edge portions adapted to fit into said channels and spaced from one another by a distance only moderately greater than a distance between said channel members, so that each of said spacing elements can be inserted into said channels by first inserting one edge portion fully into said channel and then moving a second of said edge portions into alignment with a second of the channels, and with said locking portions in their engaged position, the spacing element is centered in the channel so as to be securely engaged therein.

3. The apparatus as recited in claim 2, wherein said locking portions comprise interfitting tongue and groove means located on said spacing elements and said brackets.

4. The apparatus are recited in claim 1, wherein said locking portions comprise interfitting tongue and groove means located on said spacing elements and said brackets.

5. The apparatus as recited in claim 1, wherein each of said spacing elements has its locking portions on upper and lower portions thereof so that a bracket mounted between adjacent spacing elements is locked in engaged position at upper and lower portions.

6. The apparatus as recited in claim 1, wherein the locking portion of the spacing element comprises an outwardly extending locking member centrally positioned on said spacing element, and the locking portions of the bracket comprise two laterally spaced locking elements adapted to be positioned outside of the locking members of the spacing element.

7. The apparatus as recited in claim 1, wherein the two mounting elements of each bracket comprise two laterally extending flanges, one on each arm member, with upper and lower portions of said flanges defining upper and lower locking recesses, and each of said spacing element comprises upper and downwardly extending locking members adapted to fit into respectively lower and upper locking recesses of said bracket.

8. The apparatus as recited in claim 1, further comprising a centering element fixedly attached to said spacing element and adapted to interfit with and locate a portion of a shoe tree mounted to the apparatus.

9. In a shoe display and mounting apparatus, having a base member defining a slideway having two inwardly facing channel members defining related channels, a mounting bracket adapted to be mounted to said slideway, said bracket having an inner mounting end and an outer end and comprising:

a. two laterally spaced arm members at the inner end of the bracket, b. two laterally extending mounting elements located one on each arm member and adapted to fit in a related one of said channels, c. said arm members being capable of being yieldingly pressed laterally towards one another so that said mounting elements can be inserted into said channels, d. said arm members having locking portions adapted to interfit with a related spacing element which would also be mounted to said apparatus, and having an engaged position and a disengaged position, with the locking portions in the engaged position holding said arm members in said channels.

10. The apparatus as recited in claim 9, wherein said locking portions comprise a matching portion of tongue and groove means on said brackets.

11. The apparatus as recited in claim 9, wherein each of said arm members have their locking portions on upper and lower portions thereof so that a bracket mounted between adjacent spacing elements is locked in engaged position at upper and lower ends.

12. The apparatus as recited in claim 9, wherein the locking portions of the bracket comprise two laterally spaced locking elements adapted to be positioned outside of a locking element of a related spacing element.

13. The apparatus as recited in claim 9, wherein the two mounting elements of each bracket comprise two laterally extending flanges, one on each arm member, with upper and lower portions of said flanges defining upper and lower locking recesses adapted to interfit with locking elements of related spacing members.

* * * * *